US006907933B2

(12) United States Patent
Choi et al.

(10) Patent No.: US 6,907,933 B2
(45) Date of Patent: Jun. 21, 2005

(54) SUB-SEA BLOW CASE COMPRESSOR

(75) Inventors: Michael S. Choi, Houston, TX (US); Donald C. Elliot, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 170 days.

(21) Appl. No.: 10/366,221

(22) Filed: Feb. 13, 2003

(65) Prior Publication Data

US 2004/0159437 A1 Aug. 19, 2004

(51) Int. Cl.[7] ..... E21B 43/34
(52) U.S. Cl. ..... 166/357; 166/265; 166/267
(58) Field of Search ..... 166/351, 357, 166/265, 267

(56) References Cited

U.S. PATENT DOCUMENTS

| | | | | | |
|---|---|---|---|---|---|
| 4,091,881 | A | | 5/1978 | Maus | 175/7 |
| 4,099,583 | A | | 7/1978 | Maus | 175/7 |
| 4,232,903 | A | | 11/1980 | Welling et al. | 299/8 |
| 4,265,599 | A | | 5/1981 | Morton | 417/54 |
| 4,527,632 | A | * | 7/1985 | Chaudot | 166/357 |
| 4,995,460 | A | * | 2/1991 | Strahan | 166/267 |
| 5,009,680 | A | | 4/1991 | Brekke | 55/40 |
| 5,044,440 | A | | 9/1991 | Stinessen et al. | 166/344 |
| 5,340,283 | A | | 8/1994 | Nagata | 417/118 |
| 5,382,141 | A | | 1/1995 | Stinessen | 417/423.8 |
| 5,398,762 | A | | 3/1995 | Stinessen | 166/356 |
| 5,490,562 | A | * | 2/1996 | Arnold | 166/267 |
| 5,762,149 | A | | 6/1998 | Donovan et al. | 175/40 |
| 6,003,603 | A | * | 12/1999 | Breivik et al. | 166/357 |
| 6,296,060 | B1 | | 10/2001 | McCaslin | 166/357 |
| 6,328,107 | B1 | | 12/2001 | Maus | 166/335 |
| 6,412,562 | B1 | | 7/2002 | Shaw | 166/335 |
| 6,640,901 | B1 | * | 11/2003 | Appleford et al. | 166/357 |
| 6,672,391 | B2 | * | 1/2004 | Anderson et al. | 166/357 |
| 2003/0188873 | A1 | * | 10/2003 | Anderson et al. | 166/357 |
| 2004/0069494 | A1 | * | 4/2004 | Olsen et al. | 166/357 |

FOREIGN PATENT DOCUMENTS

| | | |
|---|---|---|
| EP | 0 568 742 A1 | 11/1993 |
| FR | 2 272 888 A1 | 12/1975 |

* cited by examiner

*Primary Examiner*—Frederick L. Lagman
(74) *Attorney, Agent, or Firm*—Hitchcock Evert LLP

(57) ABSTRACT

A sub-sea submersible compressing apparatus having at least one compressor tank. A compressor tank is configured to receive gas from a gas/liquid separator and has an inlet for water. The compressor further comprises a pump to pump water from the compressor tank thereby drawing gas into the compressor tank from the gas/liquid separator. Valves are provided to shut off gas flow from the liquid/gas separator and to permit gas flow from the compressor tank to a predetermined location such as a recovery line for transferring the gas to the surface or other location. The gas contained within the compressor tank is compressed by allowing water to flow back into the compressor tank, thereby compressing the gas and forcing it from the compressor vessel. Two or more compressor tanks can be provided to facilitate a continuous operation by timing of the water flow to and from each of the compressor tanks.

31 Claims, 5 Drawing Sheets

SINGLE ACTING CYCLE

| MEASUREMENT | VALVE 50 | VALVE 52 | PUMP 56 | PROCESS |
|---|---|---|---|---|
| DP1 MINIMUM | OPEN | CLOSE | STOP | START COMPRESSION |
| DP1 MAXIMUM | CLOSE | CLOSE | STOP | STOP COMPRESSION |
| DP1 MAXIMUM | CLOSE | OPEN | RUN | START INTAKE |
| DP1 MINIMUM | CLOSE | CLOSE | STOP | STOP INTAKE |

DOUBLE ACTING CYCLE

| MEASUREMENT | VALVE 50 | VALVE 52 | VALVE 86 | VALVE 88 | PROCESS 38 | PROCESS 72 |
|---|---|---|---|---|---|---|
| DP1 MINIMUM | OPEN | CLOSE | CLOSE | OPEN | COMPRESSION | INTAKE |
| DP1 MAXIMUM | CLOSE | CLOSE | CLOSE | OPEN | HOLD | |
| DP2 MINIMUM | CLOSE | OPEN | OPEN | CLOSE | INTAKE | COMPRESSION |
| DP2 MAXIMUM | CLOSE | OPEN | CLOSE | CLOSE | | HOLD |

SUB-SEA BLOW CASE COMPRESSOR

TECHNICAL FIELD

The present invention relates to compressor apparatus for gas production from underwater wells. In particular the invention relates to a compressor for gas production from an underwater well.

BACKGROUND OF THE INVENTION

The invention relates to a submersible compressing station for a well producing gas and oil. The invention has the greatest applicability to offshore oil and gas production, although it may be employed in lakes and bays as well. In such production, wells are drilled from a platform or a semi-submersible vessel, or a drill ship, etc. on the surface of the water into the subsea formations. The well bore is drilled into a petroleum producing formation and the well is completed, i.e. put in condition for producing gas and oil. Many times oil present in a hydrocarbon reservoir contains dissolved gas and the capability of the oil to hold such gas decreases as the pressure decreases and temperature increases.

Once a well is placed in production the raw material flowing from the well may be transported to the surface through a tubing string or riser, or may be transported to the shore through a sub-sea pipeline. Frequently a liquid/gas separator is employed to separate the gas from the oil and water which can be produced by the well. It is often desirable to operate oil and gas production separators at low pressures to improve the well productivity and recovery. When the pressure of the separated gas from the liquid/gas separator is too low to flow to its destination, a gas compressor is usually employed to boost its pressure.

Sub-sea production separators, i.e. separators located on the sea bed, have been used. When sub-sea separators are utilized then the gas compressor must also be located on the sea bed. The disadvantages of mechanical gas compressors include that they often require more power than is practical to supply sub-sea, they have a complex construction, and they are complex to operate and difficult to maintain.

Thus, there has been a need for a reliable sub-sea gas compressor having a robust construction which is simple to maintain and operate. The present invention has the advantages over mechanical gas compressors by utilizing a simple system which consumes less power, and is simpler to operate and maintain.

SUMMARY OF THE INVENTION

In one embodiment the invention relates to a compressor system suitable for use underwater. While the invention may be used in freshwater or seawater its greatest application will be found in offshore applications.

In one embodiment the present invention relates to the submersible compressing apparatus which is attached to a gas/liquid separator. The gas/liquid separator has an opening for connection to the well head, a gas exit opening and a production liquid exit. A separator gas conduit is connected to the gas exit opening of the gas/liquid separator and is connected to a gas valve. Connected to the liquid/gas separator is a first compressor tank which has first and second openings. The first opening of the compressor tank is connected to the gas valve by a production conduit and the production conduit also has a gas production valve connected to it. The gas production valve is connected to a conduit for carrying the gas to a desired location, such as to the surface or to the shore. Connected to the second opening of the compressor tank is a liquid conduit. The liquid conduit is connected to a inlet valve and a tank valve. The tank valve is connected to a evacuation conduit which is connected to a pump. In operation, raw material from the well is separated into liquid and gas phases in the liquid/gas separator. The inlet valve to the compressor tank is opened and water from the environment is allowed to flood the tank. The inlet valve is then closed and the tank valve opened. The pump is started and water is pumped from the compressor tank. As a result the pressure in the compressor tank is decreased and the gas valve is opened allowing gas to flow from the liquid/gas separator into the compressor tank. Once the desired amount of gas has flowed into the compressor tank the tank valve is closed and the pump stopped. Thereafter, the gas valve to the liquid/gas separator is closed and the gas production valve is opened. Then the inlet valve to the compressor tank is opened allowing water to again fill the tank. The hydrostatic head of the water surrounding the compressing apparatus in the environment provides pressure to compress and push the gas out of the first compressor tank. When a desired amount of water has entered the compressor tank the inlet valve is closed and the process is repeated.

In a preferred embodiment, the present invention relates to a submersible compressing apparatus which contains two or more compressor tanks and preferably more than two compressor tanks. Use of at least two compressor tanks is preferred because production into the compressing apparatus can be more continuous than in the single compressor tank configuration which operates in an interruptible fashion. In a preferred embodiment, there is a first compressor tank which has a first and second opening. A first production conduit is attached to the first opening of the first compressor tank. Also connected to the first production conduit is a first production gas valve for connection to a riser, and a first gas valve for connection to a liquid/gas separator. Connected to the second opening is the first liquid conduit which has connected to it a first inlet valve and a first tank valve. Connected to the first tank valve is an evacuation conduit. The second tank and any additional compressor tanks have a similar construction. The evacuation conduit which is attached to the tank valve of the first compressor tank and to the tank valve of the second compressor tank is connected to a pump. This compressing apparatus operates in a fashion similar to the above described methodology. However, in this embodiment as one compressor tank is being flooded with water to compress the gas for transport to the surface the other compressor tank(s) are having water evacuated from it in order to draw in gas from the liquid/gas separator. The rate at which a tank is flooded and the rate at which water is pumped from it are proportioned preferably such that a nearly continuous intake of gas to the compressor apparatus can be achieved. More than two compressor tanks can be employed in the apparatus if desired. These additional compressor tanks can be utilized to enhance continuous flow or can be employed as reserve units in the event one of the primary tanks fails.

The compressing apparatus may be operated in an open circuit mode in which ambient water is allowed to flow into the compressor tanks and is then pumped out of the compressor tanks into the sea. Alternatively, return conduits and valves can be provided such that there is a closed system in which water or other incompressible liquid is pumped from one of the compressor tanks to the other compressor tank so as to provide a closed system in which the fluid is repeatedly transferred from one tank to the other.

BRIEF DESCRIPTION OF THE DRAWINGS

The present invention will be better understood with reference to the figures in conjunction with the detailed description of preferred embodiments.

DETAILED DESCRIPTION

Figure 1:
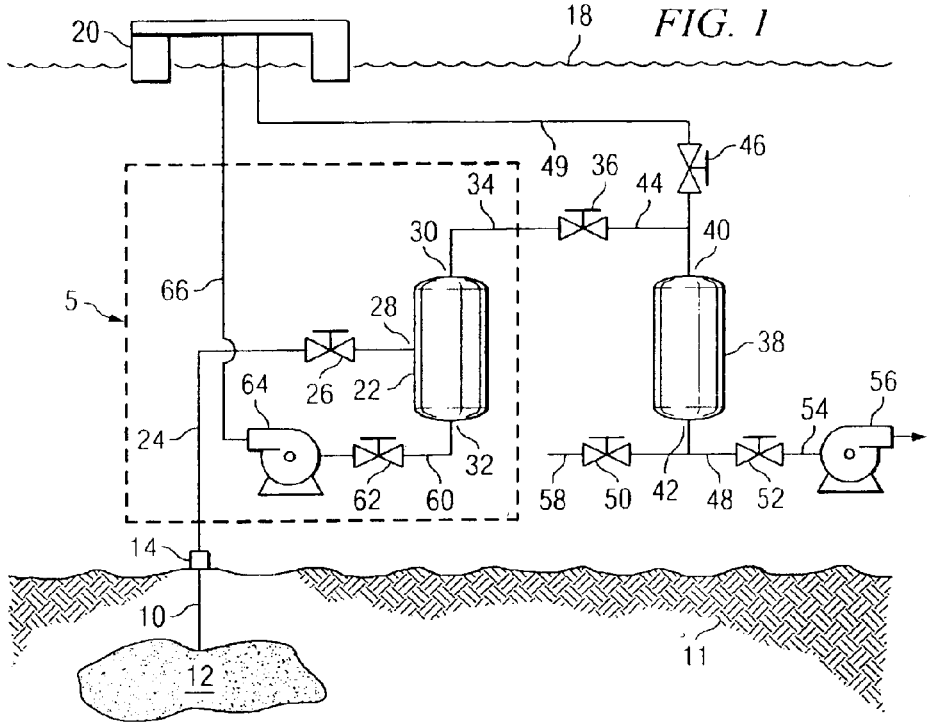
FIG. 1 is a schematic view of a pumping apparatus with a single compressor tank.

FIG. 1 illustrates one embodiment of a submersible compressing apparatus of the present invention. It is believed that the invention will have the greatest application to offshore production, and thus, the preferred embodiments will be discussed in relation to that environment. It being understood that the invention can also be employed in other water environments. A well bore 10 has been drilled through the seabed 11 into an offshore petroleum reservoir 12 and has a well head 14 on the sea bed 16. At the surface 18 of the sea is platform 20. The well head 14 is connected to a liquid/gas separation system 5, enclosed by the dashed box. The primary component of the liquid/gas separation system 5 is the liquid/gas separator 22. The liquid/gas separator 22 is connected to the well head 14 by well head conduit 24. Interposed in well head conduit 24 is well head valve 26 which controls flow of the raw material produced by the well into liquid/gas separator 22. Liquid/gas separator 22 has a raw material opening 28 connected to the well head conduit 24 and has a gas opening 30 and a production liquid opening 32. A gas conduit 34 is connected to the gas opening 30 at one end and at the other end to a first gas valve 36.

The compressing apparatus includes a first compressor tank 38 which has a first opening 40 and a second opening 42. First opening 40 is connected to production conduit 44. Production conduit is connected to first gas valve 36 opposite the gas conduit 34. A first production gas valve 46 is also connected to the first production gas conduit 44. Attached to the second opening 42 is first liquid conduit 48. First liquid conduit 48 is attached to a first inlet valve 50 and a first tank valve 52. Attached to the first tank valve 52 opposite the first liquid conduit 48 is evacuation conduit 54. The other end of evacuation conduit 54 is attached to pumps 56. Attached to this first inlet valve 50 opposite the first liquid conduit 48 is inlet conduit 58 that is open to the ambient sea.

In operation of this compressing apparatus raw material is feed to liquid gas separator 22 and is separated into gas and liquid phases. As a starting configuration for discussion it will be assumed that compressor tank 38 is empty. The valves on all the conduits to the first compressor tank 38 are closed. Then the first inlet valve 50, that has an inlet 58 which is open to the sea, is opened. When valve 50 is opened, seawater flows into first compressor tank 38 and is allowed to fill first compressor tank 38 to a desired level. At that point valve 50 is closed. First tank valve 52 is then opened and pumps 56 started and water is pumped from the first compressor tank 38. First gas production valve 46 remains closed and first gas valve 36 is opened. As water is pumped from tank 38, gas is drawn from liquid/gas separator 22 into first compressor tank 38. When the desired amount of liquid has been withdrawn from compressor tank 38, valve 52 is closed and pump 56 is stopped. Gas valve 36 is then closed and first gas production valve 46 is opened. Thereafter, first inlet valve 50 is opened allowing seawater to again flow in and fill compressor tank 38. The hydrostatic head of the water is used to compress the gas in first compressor tank 38 and cause it to flow through production conduit 44 and first gas production valve 46 into riser 49 then to the surface.

While FIG. 1 has shown the present invention with the gas being transported to the surface of the sea, the production gas can also be compressed to any desired location, such as a sub-sea pipeline and transported to a shore facility through the pipeline, or exhausted into the sea.

Production liquid from the gas/liquid separator 22 flows through production liquid conduit 60 and liquid valve 62 and is pumped by pump 64 to the surface or other desired location through conduit 66.

In the figures, like reference numbers refer to the same or similar items.

Figure 2:
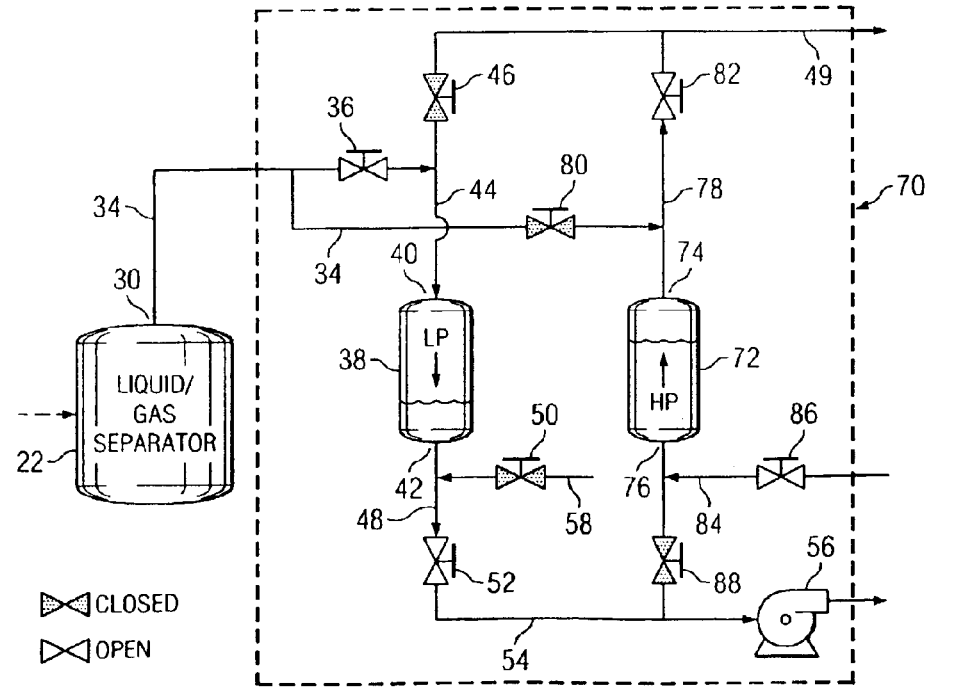
FIG. 2 is a schematic view of a pumping apparatus having two compressor tanks in a first cycle of operation.

FIG. 2 illustrates a preferred embodiment of the present invention. In FIG. 2 the dashed box shows submersible compressor 70 of the present invention. Submersible compressor 70 is comprised of two tank units. A first compressor tank unit 38 is provided with related conduits and valves as discussed with reference to FIG. 1. In this embodiment a second compressor tank 72 is provided which has a first opening 74 and a second opening 76. Connected to the first opening 74 of the second compressor tank 72 is a second production gas conduit 78. Attached to the second production conduit 78 is second gas valve 80 and second gas production valve 82. Second gas valve 80 on the side opposite of the second production conduit 78 is connected to gas conduit 34. The side of the second gas production valve 82 is connected to riser 49. The second opening 76 is connected to second liquid conduit 84. A second inlet valve 86 is connected to the second liquid conduit 84. Also connected to the second liquid conduit is second tank valve 88. Connected on the opposite side of the second tank valve 88 is first evacuation conduit 54. The evacuation conduit 54 is attached to pump 56. FIG. 2 illustrates the phase of the compressing operation in which water is being drawn out of the first tank 38 thereby creating a low pressure area which draws gas into the first compressor tank 38. At the same time inlet valve 86 is open and water is flowing into second compressor tank 72 forcing gas out of the second tank 72 through production gas conduit 78 and the second gas production valve 82 and into riser 49.

Figure 3:
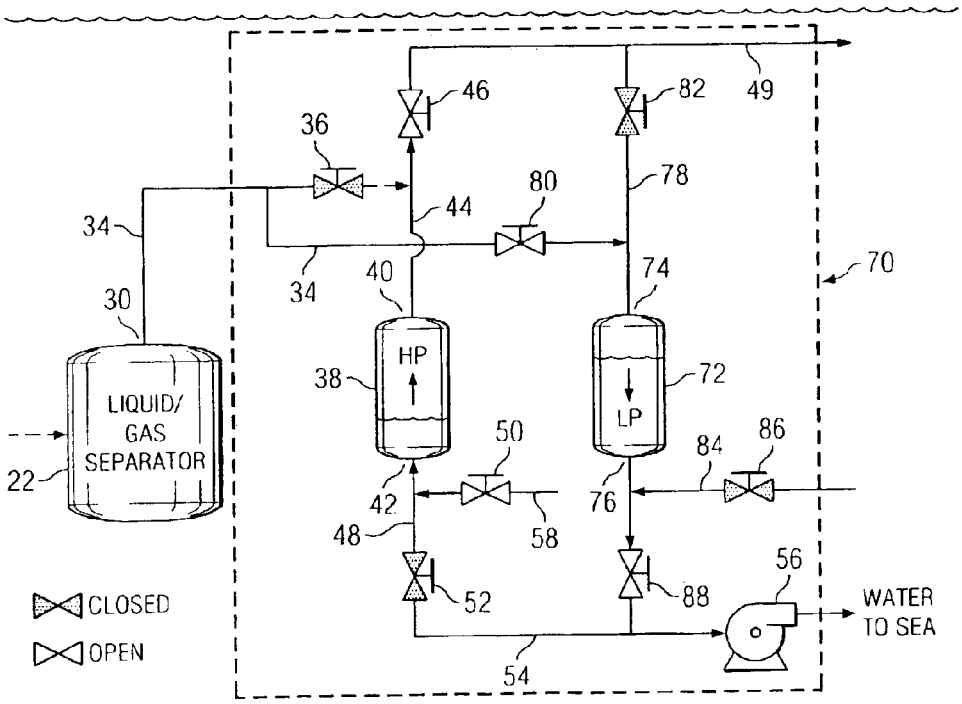
FIG. 3 is a schematic view of the pumping apparatus of FIG. 2 having two compressor tanks in a second cycle of operation.

FIG. 3 shows the valve configurations for compressor 70 in the second cycle where gas is being pulled into the second tank 72 and compressed and expelled from tank 38. As can be seen in this cycle first tank valve 52, first gas valve 36, second inlet valve 86 and second production gas valve 82 are closed, while first inlet valve 50, first production gas valve 46, second tank valve 88 and second gas valve 80 are open.

Figure 4:
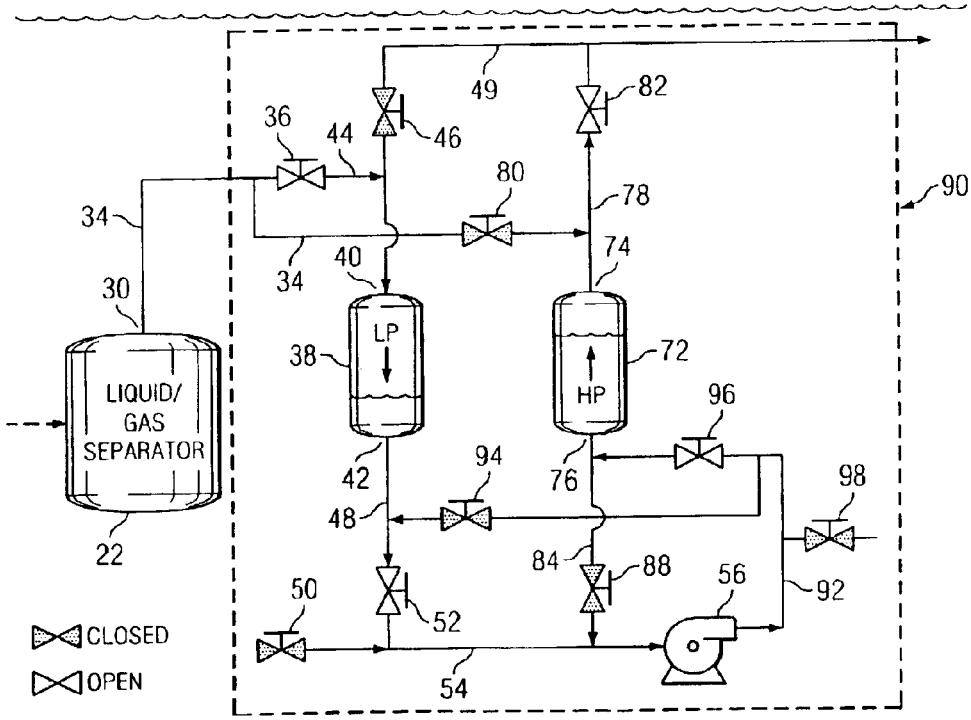
FIG. 4 is a schematic view of another pumping apparatus having two compressor tanks and return lines for the water in a first cycle of operation.

FIG. 4 shows another preferred embodiment of the present invention, a closed circuit compressor 90 indicated by the dashed box. Many of the components of the closed circuit compressor and the open circuit compressor 70 illustrated in FIGS. 2 and 3 are the same with the exception of the piping and valve arrangement for controlling water or liquid flow. In this embodiment, the closed circuit compressor has a first inlet valve 50 which is connected to the evacuation conduit 54. The first liquid conduit 48 is connected to first tank valve 52 and first return valve 94. The second liquid conduit 84 is connected to second tank valve 88 and second return valve 96. The return conduit 92 is connected to first return valve 94 and second return valve 96 and to the output end of pump 56. This construction allows water to be pumped into either compressor tank. In a preferred embodiment the return conduit has an exhaust valve 98 connected to it which can be opened to pump water/liquid into the sea or reclaimed through the liquid/gas separation system 5, more fully described in FIG. 1.

If the compressor 90 is placed in position with both tanks empty, then by opening first inlet valve 50 one of the tanks may be filled with water to the desired level. This may be done in two manners. For example, both the first and second return valves 94 and 96 are closed and either the first the second tank valves 52 or 88 is closed. The tank valve which is not closed is opened so that the tank connected to the open inlet valve 50 will be filled. The second manner of making the initial charge of water is to close both the first and second tank valves 52 and 88 and either one of the first or second return valves 94 and 96, the other return valve is opened. When first inlet valve 50 is opened seawater can be allowed into the evacuation conduit and through pump 56 and the open return valve and may fill either first tank 38 or second tank 72 depending upon which return valve 94 or 96 is open. Alternatively, either valves 52 or 88 can be opened allowing water to flow into selected tanks under the force of the hydrostatic head. Once one of the tanks 38 or 72 is filled with the desired amount of water, first inlet valve 50 is closed. Now that one of the tanks is filled the compressing mode is achieved by repeatedly transferring water from one compressor tank to the other compressor tank. In the illustrated phase of the compressing in FIG. 4, the first compressor tank 38 was previously filled with water and is now being evacuated in order to draw gas from the liquid/gas separator 22 into the first compressor tank 38 in a manner similar to that described with reference to FIGS. 2 and 3. This is done by opening valve 52 and starting pump 56. In contrast to the open system of FIGS. 2 and 3, pump 56 pumps the water into return conduit 92. Return conduit 92 has attached to it a first return valve 94 which is connected to the first liquid conduit 48 and has a second return valve 96 connected to second liquid conduit 84. In the illustration, the first return valve 94 is closed preventing the water from flowing back into the first compressor tank 38. Second return valve 96 is open and the water is pumped into the second compressor tank 72, thereby expelling the gas from second compressor tank 72 through open second production gas valve 82 and into the gas riser 49.

Figure 5:
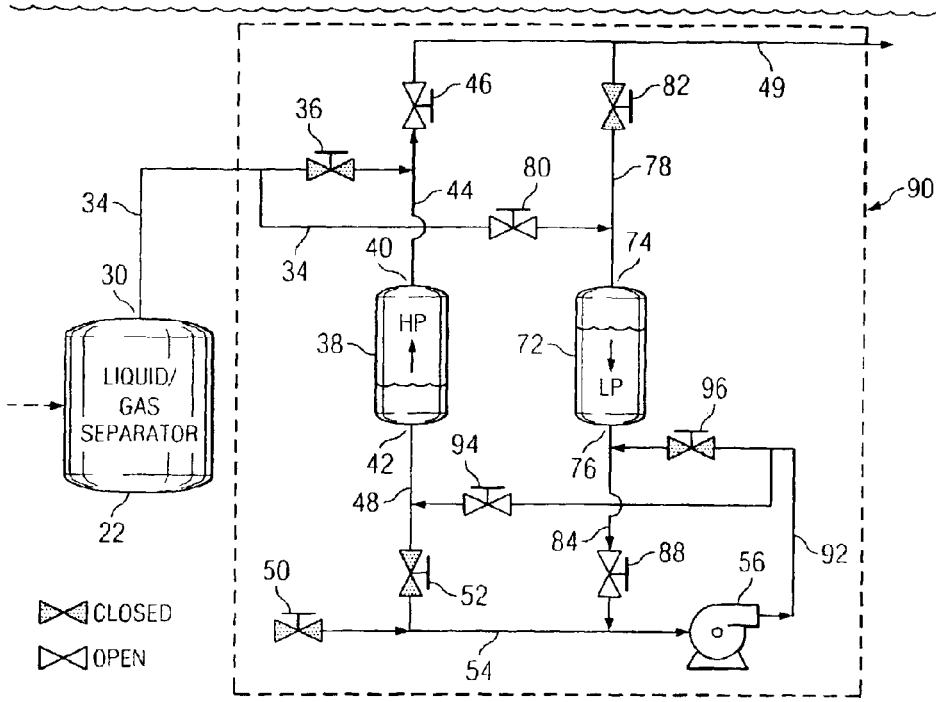
FIG. 5 is a schematic view of the pumping apparatus of FIG. 4 having two compressor tanks and return lines for the water in a second cycle of operation.

In the second cycle water is pumped from second compressor tank 72 into first compressor tank 38 as illustrated in FIG. 5. In FIG. 5, first inlet valve 50, first tank valve 52, first gas valve 36, second return valve 96 and second production gas valve 82 are closed. First gas production valve 46, first return valve 94, second gas valve 80, and second tank valve 88 are open allowing pump 56 to pump water from the second compressor tank 72 into first compressor tank 38.

As illustrated in FIG. 4, the compressor 90 can include an exhaust valve 98 in the return conduit 92. In this manner both compressor tanks can be completely or partially filled with water at the surface prior to being submerged. After submersion and installation, water from one of the compressor tanks is pumped into the sea through the exhaust valve in the initial start-up operation. Thereafter, the exhaust valve is closed and the water is transferred from the remaining tank into the first tank in a cyclic function to achieve the compression as described above. This has the advantage that the compressor tanks can be preloaded on the surface with deaerated water or fresh water containing corrosion inhibitors which would be less corrosive to the compressor than utilizing seawater. In this embodiment it is also beneficial to have the inlet valve 50. This will allow use of seawater in the event that all of the freshwater is inadvertently exhausted into the sea or to make up for loss through evaporation. In another alternative, a compressor tank could be preloaded with an incompressible liquid other than water such as hydraulic fluid.

Further, in the closed circuit embodiment neither the first inlet valve 50 nor the exhaust valve 98 is required. One of the compressor tanks can be filled with water or other incompressible liquid at the surface. Thereafter, the compressor 90 can be submerged and installed. Liquid can then be pumped from one tank to the other. This embodiment is considered less desirable as it limits the ability to take corrective action or make repairs without retrieving the compressor to the surface.

Another potential function of exhaust valve 98 is to facilitate the reclaiming of any condensate that may be produced in the compressor system. Over time, heavier hydrocarbons or other constituents in the inlet gas can condense in the compressor tanks 38 and 72. It may then be desirable to reclaim the condensate by routing the fluid through pump 56 and exhaust valve 98, and a conduit not shown, to the liquid/gas separation system 5. Once the reclaimed condensate is in the liquid/gas separation system 5, it can be commingled with the production liquid from the well and transported to the surface or other desired location through conduit 66.

Figure 6:
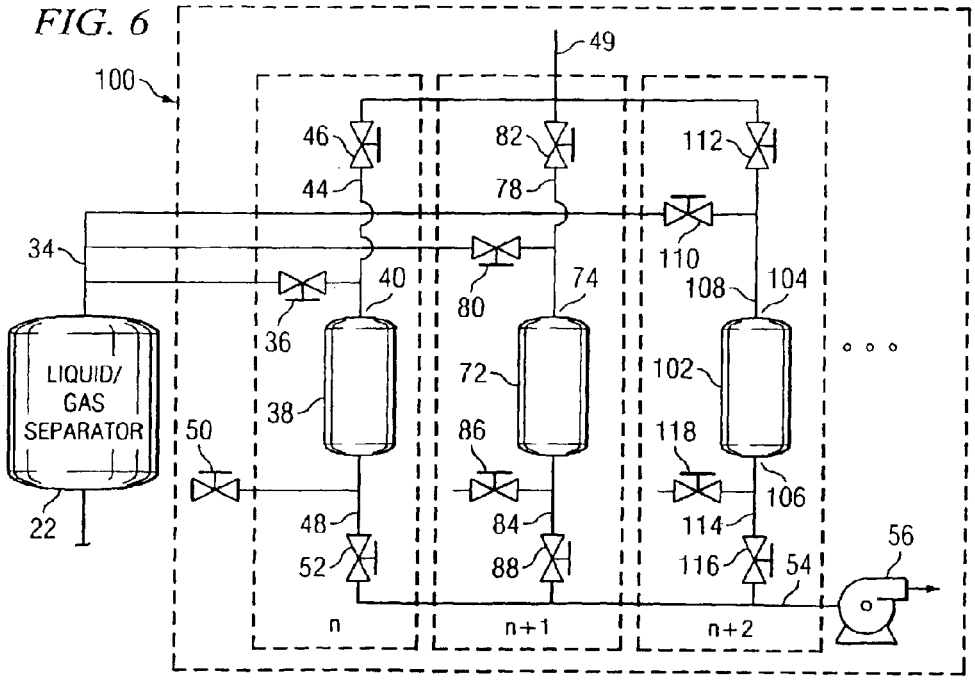
FIG. 6 is a schematic view of another embodiment of the invention utilize multiply compressor tanks.

FIG. 6 illustrates a compressor 100 which is an open circuit compressor. Compressor 100 differs from compressor 70 shown in FIGS. 2 and 3 in that it contains a third compressor tank 102 (n+2) having a first opening 104 and a second opening 106. Connected to the first opening 104 of the third compressor tank 102 is production gas conduit 108. Production gas conduit is connected to third gas valve 110 and a third gas production valve 112. The second opening 106 of the third compressor tank 102 is connected to third tank conduit 114 which is connected to third tank valve 116 and third inlet valve 118. The other side of the tank valve 116 is connected to evacuation conduit 54. This embodiment can be useful to provide a unit which has a spare compressor tank so that if one of the compressor tanks springs a leak it can be closed off and compressing continued with the other two. Alternatively, all three tanks can be operated in a three-phase cycle.

The compressor of the invention can have any number of additional compressor tanks (n, n+1, n+2, n+3, etc.), each having a similar arrangement of conduits as explained above. Use of multiple tanks can be beneficial in that the sequencing of the tanks can be timed such that the fluid pump 56 runs continuously, and to smooth out the pressure and gas flow from the liquid/gas separation system 5, and into the gas export user 49.

Figure 7:
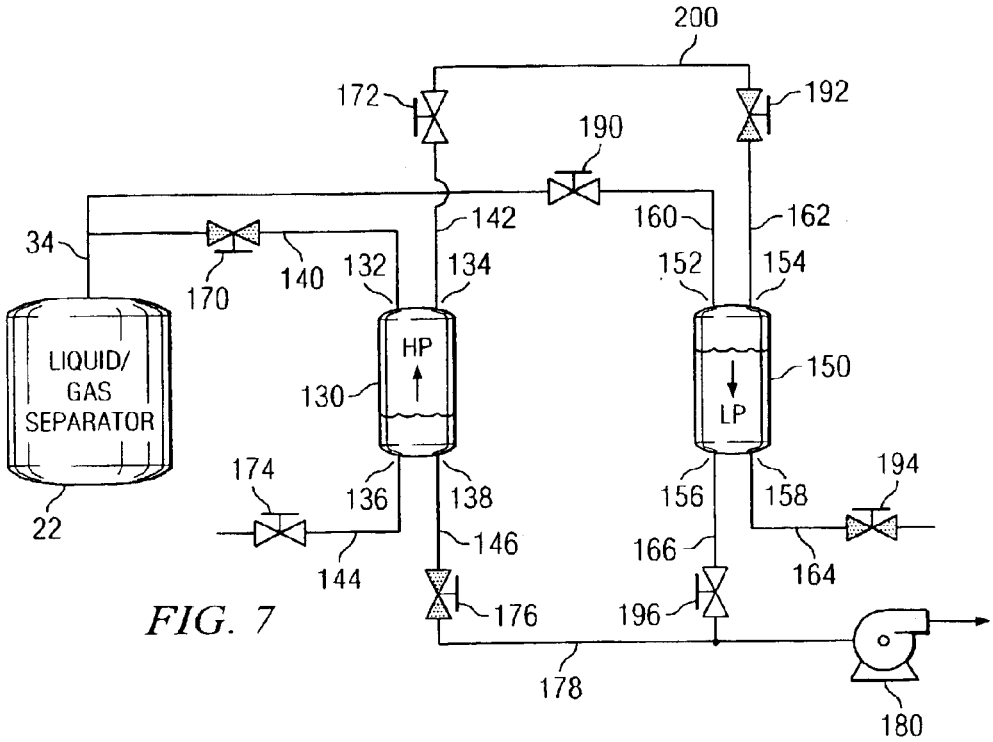
FIG. 7 is a schematic view of another embodiment of the invention.

FIG. 7 shows yet another embodiment of the present invention. In this embodiment separate openings for inflow and outflow from each of the compressor tanks are provided. One opening for a gas inlet, another opening for gas exit, an opening for water inlet, and an opening for water outflow. This embodiment is considered less preferable because of the additional openings in the tank and the additional piping. This embodiment has a first compressor tank 130 with a gas inlet opening 132 and a gas exit opening 134, a liquid inlet 136 and a liquid exhaust opening 138. Connected to gas inlet opening 132 is first gas inlet conduit 140, connected to the gas exit opening 134 is a first production gas conduit 142. A first liquid inlet conduit 144 is connected to the first liquid inlet 136, and a first liquid exit conduit 146 is connected to a first liquid exhaust opening 138. A second compressor tank 150 is provided with a gas inlet opening 152 and a gas exit opening 154, a liquid inlet opening 158 and a liquid exhaust opening 156. Connected to gas inlet opening 152 of the second compressor tank is second gas inlet conduit 160, connected to the gas exit opening 154 of the second compressor tank is second production gas conduit 162. A second liquid inlet conduit 164 is connected to the second liquid inlet 158, and a second liquid exit conduit 166 is connected to the second liquid exhaust opening 156.

Connected to the first gas inlet conduit 140 is first gas valve 170 which is connected on the other side to gas conduit 34 from the liquid/gas separator 22. A first production gas valve 172 is connected to the first production gas conduit 142. A first inlet valve 174 is connected to the first liquid inlet conduit 144 and a first exhaust valve 176 is connected to the first liquid exit conduit 146. The opposite side of first exhaust valve 176 is connected to evacuation conduit 178 which is connected to pump 180. A similar construction is used with respect to the second compressor tank 150. Connected to the second gas inlet conduit 160 is second gas valve 190 which is connected on the other side to gas conduit 34 from the liquid/gas separator 22. A second production gas valve 192 is connected to the second production gas conduit 162. A second inlet valve 194 is connected to the second liquid inlet conduit 164 and a second exhaust valve 196 is connected to the second liquid exit conduit 166. The opposite side of second exhaust valve 196 is connected to evacuation conduit 178 which is connected to pump 180.

In one cycle of operation the first gas valve 170, second production gas valve 192, first exhaust valve 176 and second inlet valve 194 are closed, and second gas valve 190, first production gas valve 172, second exhaust valve 196 and first inlet valve 174 are opened. Pump 180 is started. The inflow of water through first inlet valve 174 and into the first compressor tank 130 causes gas to be compressed and expelled through the first gas production valve 172 and into riser 200. The pump 180 withdraws water from the second compressor tank 150 through second exhaust valve 196 which causes gas to be drawn into the second compressor tank 150 from the liquid gas separator 22 through second gas valve 190. The process is reversed in a similar fashion as described above to produce a second compressing cycle.

Other valving and piping arrangements may be utilized. The exact arrangement of the conduits and valves is not important. Thus, a conduit means for passage of gas into and out of the compressor tanks can be a single conduit as described in reference to FIGS. 2 and 3, or multiple conduits as described in reference to FIG. 7. A conduit means for passage of liquid into and out of the compressor tanks can be a single conduit as described in reference to FIGS. 2 and 3, or multiple conduits as described in reference to FIG. 7. A valve means to control inlet and outlet of gas from the compressor tanks can be connected to a common conduit as described in reference to FIGS. 2 and 3, or individual conduits as described in reference to FIG. 7. Also a valve means for controlling the inlet and exit of liquid from the compressor tanks can be connected to a common conduit as described in reference to FIGS. 2 and 3, or individual conduits as described in reference to FIG. 7 and can include valve means to control the use of a return-conduit as described in reference to FIG. 6. Finally the pump means is a pump which will either exhaust liquid to the surrounding sea or will recycle the liquid from one tank to the other.

In one embodiment the invention can be n compressor tank units (where n is an integer of 2 or more). Each unit has a compressor tank; with conduit means for passage of gas into and out of each of the n compressor tanks; with conduit means for passage of liquid into and out of each of the n compressor tanks, valve means to control inlet and outlet of gas from each compressor tank, valve means for controlling the inlet and exit of liquid from each compressor tank; and a pump means for exhausting liquid into the ambient surrounding or to transfer liquid from one compressor tank to another. Preferably n is 6 or less.

The compressor tanks of the present invention are preferably made of high strength material such as steel, titanium and stainless steel. Also it may be desirable to treat the surface of certain parts of the compressor with corrosion resistant layers. The pump to transfer water or other fluid in the compressor can be of suitable centrifugal or reciprosating design powered by an electric motor or other means. The valves may be of any suitable design and at certain valves may be check valves.

In operation the valves are sequenced and the water pump controlled based upon consideration of the following preferred operations: (1) during the compression process gas should not be allowed to back flow from the gas discharge piping into the separator; (2) during the intake process gas should not be allowed to back flow from the gas discharge piping into the compressor tank; (3) during the compression process water (or other liquid) should not be allowed to exit the compressor tank into the gas outlet conduit; (4) during the intake process gas should not be allowed to enter the water/liquid pump. Operations 1 and 2 can be satisfied by use of check valves, which open when the pressure across the valve in the direction of flow is positive, and closed to prevent back flow when pressure across the valve in the direction of flow is a negative. Alternatively, an actuated valve with the differential pressure instrument across the valve can be used instead of a check valve. In this situation, the sequencing system would open the valve when the pressure measured across the valve in the desired direction of flow is positive, and would close the valve when the pressure measured across the valve in the desired direction of flow is negative. The sequencing of the actuated valves can be dependent only on the differential pressure across the valve without regard to any other measurements. With regard to operations 3 and 4, they specify conditions at which the compression process and the intake process respectively should be stopped.

Figure 8A:
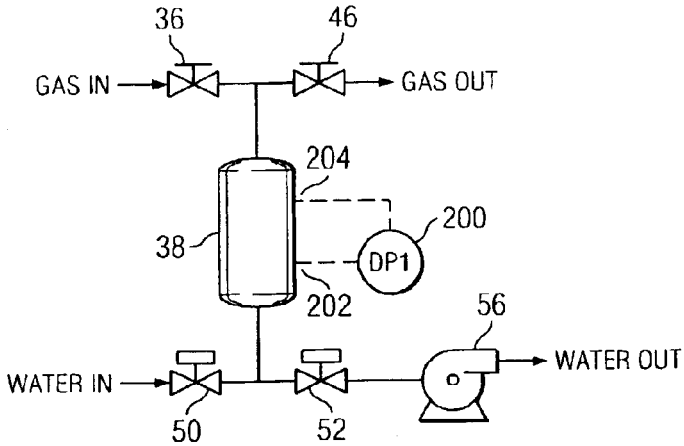
FIG. 8A is a schematic view of a single compressor tank and a table showing the single acting compressing cycle.

Referring now to FIG. 8A, closing valve 50 when the water level in the compressor tank reaches a predetermined maximum amount the compression process is stopped. With no water entering the compressor tank, the water level in the compressor tank will not rise further, and water thus will not overfill the compressor tank. Closing valve 52 when the water level in the compressor tank reaches a predetermined minimum amount stops the intake process described in operation 4 above. With no water exiting the compressor tank, the water level will not decrease further and the water seal will be maintained to prevent exit of gas into the conduits to pump 56.

A single acting sequence is shown in FIG. 8A. A single acting compressor cycle, using only compressor tank 38, is illustrated. With a single compressor tank, the compression process is started immediately after the intake process is stopped and vice versa. Check valves can be used for the gas valves. A differential pressure instrument 200 connected at the desired minimum 202 and maximum 204 water levels in vessel compression tank 38 is used to infer the water level. The differential pressure will be at a maximum when the water level is at a maximum and the differential pressure will be at a minimum when the water level is at a minimum. Thus, when the differential pressure instruments 200 senses a minimum level, the intake process is stopped and the compression process is started, and when the differential pressure instrument 200 senses a maximum level, the compression process is stopped and the intake process is started. This is a preferred method for control. It will be appreciated by those skilled in the art that other sensing instruments other than differential pressure measuring instruments may be used to generate control signals.

Figure 8B:
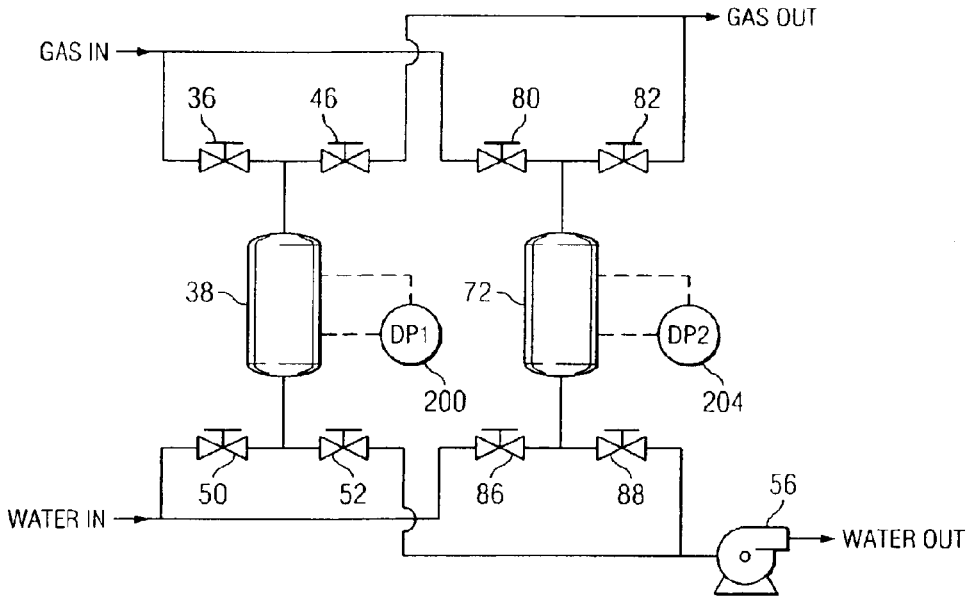
FIG. 8B is a schematic view of two compressor tanks and a table showing the double acting compressing cycle.

FIG. 8*b* shows sequencing and multiple compressor tank apparatus. Each of the four processes is applied to each vessel in the multiple compressor tank compressor. Check valves or actuated valves (36, 46, 80, 82) can be used on the gas side of each compressor tank to satisfy the first and second operations. Closing the corresponding water valves (50, 52, 86, 88) to stop the compression process or to stop the intake process in each vessel will satisfy criteria 3 and 4. A preferred method of operation is to stop the intake process and start the compression process on a single tank simultaneously while starting the intake process on another vessel in an apparatus having 3 or more compressor tanks as each of the other tanks may be in different phases of compression or intake steps. It is considered best practice that starting the intake process on a compressor tank immediately on stopping the intake process on another compressor tank allows pump 56 to operate continuously and not to be stopped or started during the cycling. It is believed that continuous operation of the pump prevents or minimizes wear and tear caused by starting and stopping the pump and would increase pump life. An additional factor in a preferred method of operation is that it should be assured that the compression process has sufficiently advanced in the compressor tank for which the intake process will be started. If the level in the compressor tank performing the compression process is not increased so as to sufficiently compress the gas to open the gas outlet valve 46, then stopping the compression process and starting the intake process will prevent compressed gas from being discharged in this compressor outlet piping. The cycle will then accomplish nothing more than to move water around.

To ensure the compressed gas is actually discharged, the water valves, and conduits and the pump should be sized with consideration to the water depth and other relevant factors for the environment of use such that water entering the compressor tanks from the ocean at a greater rate than the pump can pump water out of the compressor tanks. This assures that the compression process will always take less time to complete than the intake process. Thus, in multiple compressor tank configuration, it can be assured that when the intake process in one vessel is stopped, there will be another vessel for which the compression process has been stopped and is waiting to start the intake process.

A double cycle is illustrated in FIG. 8B. A differential pressure instrument 200, 204 is used to infer the water level in each compressor tank and water valves and the pump had been sized as described above so that the compression process requires less time than the intake process. Thus, while one vessel is performing the intake process, the other vessel is performing the compression process. The level in the compressor tank performing the compression process will reach a maximum before the level in the compressor tank performing the intake process reaches a minimum. When the level in the vessel performing the compression process reaches maximum, all the water valves for that vessel are closed and the vessel remains in a holding state with no gas or water entering or exiting until the intake process on the other vessel is stopped. When the intake process on the other vessel is stopped, the compressor tanks are switched to start the intake process on the compressor tank that was performing the compression process and vice a versa. This sequencing is illustrated in the table presented in FIG. 8B.

While we have illustrated and described preferred embodiments of our invention, it is to be understood that these are capable of variations and modifications and we therefore do not wish to be limited to precise details set forth, but avail ourselves of changes and alterations as fall within the preview of the following claims.

What is claimed:

1. A submersible compressor apparatus comprising:

a gas liquid separator defining a raw material opening, a gas opening, and a production liquid opening;

a gas conduit connected to said gas opening;

a first gas valve connected to said gas conduit;

a first compressor tank defining a first opening and a second opening;

a production conduit attached to said first opening and to said first gas valve;

a first liquid conduit attached to said second opening;

a first gas production valve connected to said production conduit;

a first inlet valve connected to said first liquid conduit;

a first tank valve connected to said first liquid conduit;

an evacuation conduit attached to said first tank valve; and a pump connected to said evacuation-conduit.

2. A submersible compressing apparatus comprising:

a first compressor tank defining a first opening and a second opening;

a production conduit attached to said first opening of said first compressor tank;

a first production gas valve connected to said production conduit;

a first gas valve connected to said production conduit;

a first liquid conduit attached to said second opening of said first compressor tank;

a first inlet valve connected to said first liquid conduit;

a first tank valve connected to said first liquid conduit;

an evacuation conduit attached to said first tank valve;

a second compressor tank defining a first opening and a second opening;

a second production conduit attached to said first opening of said second compressor tank;

a second production gas valve connected to said second production conduit;

a second gas valve connected to said second production conduit;

a second liquid conduit attached to said second opening of said second compressor tank;

a second tank valve connected to said second liquid conduit;

said evacuation conduit attached to said second tank valve; and a pump connected to said evacuation conduit.

3. A submersible compressing apparatus of claim 2 further comprising a first liquid level detector connected to said first compressor tank, and a second liquid level detector connected to said second compressor tank.

4. A submersible compressing apparatus comprising:

a first compressor tank defining a first opening and a second opening;

a production conduit attached to said first opening of said first compressor tank;

a first production gas valve connected to said production conduit;

a first gas valve connected to said production conduit;

a first liquid conduit attached to said second opening of said first compressor tank;

a first return valve connected to said first liquid conduit;

a first tank valve connected to said first liquid conduit;

an evacuation conduit attached to said first tank valve;

a second compressor tank defining a first opening and a second opening;

a second production conduit attached to said first opening of said second compressor tank;

a second production gas valve connected to said second production conduit;

a second gas valve connected to said second production conduit;

a second liquid conduit attached to said second opening of said second compressor tank;

a second return valve connected to said second liquid conduit;

a second tank valve connected to said second liquid conduit;

said evacuation conduit attached to said second tank valve;

a pump having an inlet and outlet, said inlet connected to said evacuation conduit and said outlet connected to a return conduit said recycle conduit being connected to said first and said second return valves.

5. A submersible compressing apparatus of claim 4 further comprising a first liquid level detector connected to said first compressor tank, and a second liquid level detector connected to said second compressor tank.

6. A submersible compressing apparatus of claim 5, wherein said first production gas valve, first gas valve, second production gas valve, and second gas valve are automatically controlled and actuated valves.

7. A submersible compressing apparatus of claim 5 wherein said first production gas valve, first gas valve, second production gas valve, and second gas valve are check valves.

8. An apparatus of claim 4 further comprising an inlet valve connected to said evacuation conduit.

9. An apparatus of claim 4 further comprising an exhaust valve connected to said return conduit.

10. An apparatus of claim 5 further comprising an exhaust valve connected to said return conduit.

11. A submersible compressing apparatus comprising:

a first compressor tank defining first, second, third and fourth openings;

a first gas inlet conduit attached to said first opening of said first compressor tank;

a first gas valve connected to said first gas inlet conduit;

a first production gas conduit connected to said second opening of said first compressor tank;

a first production gas valve connected to said first production gas conduit;

a first liquid inlet conduit attached to said third opening of said first compressor tank;

a first inlet valve connected to said first liquid conduit;

a first liquid exit conduit connected to said fourth opening;

a first liquid exhaust valve connected to said first liquid exit conduit;

a second compressor tank defining first, second, third and fourth openings;

a second gas inlet conduit attached to said first opening of said second compressor tank;

a second gas valve connected to said second gas conduit;

a second production gas conduit connected to second opening of said second compressor tank;

a second production gas valve connected to said second production gas conduit;

a second liquid inlet conduit attached to said third opening of said second compressor, a second liquid inlet valve attached to said second liquid inlet conduit;

a second liquid exit conduit attached to said fourth opening of said second compressor tank;

a second liquid exhaust valve connected to said second liquid exit conduit;

an evacuation conduit connected to said first and second liquid exhaust valves; and a pump connected to said evacuation conduit.

12. A submersible compressing apparatus of claim 11 further comprising a first liquid level detector connected to said first compressor tank, and a second liquid level detector connected to said second compressor tank.

13. A submersible compressing apparatus of claim 12 wherein said first production gas valve, first gas valve, second production gas valve, and second gas valve are check valves.

14. A submersible compressing apparatus of claim 12, wherein said first production gas valve, first gas valve, second production gas valve, and second gas valve are automatically controlled and actuated valves.

15. A submersible compressing apparatus comprising:

(a) a first compressor tank defining openings for conduit means;

first gas conduit means for the flow of gas into and out of said first compressor tank connected to some of said openings of said first compressor tank;

first gas valve means for controlling the flow of gas in said first compressor tank connected to said first gas conduit means;

first liquid conduit means for the flow of liquid into and out of said first compressor tank connected to some of said openings of said first compressor tank;

first liquid valve means for controlling flow of liquid into and out of said first compressor tank connected to said first liquid conduit means;

a second compressor tank defining openings for conduit means;

(b) first gas conduit means for the flow of gas into and out of said second compressor tank connected to some of said openings of said second compressor tank;

second gas valve means for controlling the flow of gas in said second compressor tank connected to said second gas conduit means;

second liquid conduit means for the flow of liquid into and out of said second compressor tank connected to some of said openings of said second compressor tank;

second liquid valve means for controlling flow of liquid into and out of said second compressor tank connected to said second liquid conduit means; and (c) pump means for pumping liquid from said first compressor tank or said second compressor tank said pump means being in communication with said first and second compressor tanks.

16. A submersible compressing apparatus of claim 15 further comprising a first liquid level detector connected to said first compressor tank, and a second liquid level detector connected to said second compressor tank.

17. A submersible compressing apparatus of claim 15 wherein said first gas valve means, and second gas valve means are check valves.

18. A submersible compressing apparatus comprising:

n compressor tanks each defining openings for conduit means;

n gas conduit means for the flow of gas into and out of each respective said n compressor tanks connected to some of said openings of each respective said n compressor tanks;

n gas valve means for controlling the flow of gas in each respective said n compressor tanks connected to each respective said n gas conduit means;

n liquid conduit means for the flow of liquid into and out of each respective said n compressor tanks connected to some of said openings of each respective said n compressor tanks;

n liquid valve means for controlling flow of liquid into and out of each respective said n compressor tanks connected to each respective said n liquid conduit means;

evacuation conduit means for receiving liquid from said liquid valve means and delivery to a pump means; and pump means for pumping liquid from each respective said n compressor tanks said pump means being in communication with said n compressor tanks, wherein n=an integer from 2 to 6 via the evacuation conduit means.

19. A submersible compressing apparatus of claim 18 further comprising n liquid level detectors connected to each respective said n compressor tanks.

20. A method for compressing gas from an underwater well comprising:

separating gas from the production fluid of a gas well;

filling a tank with a predetermined amount of liquid;

drawing the separated gas produced by a well into said tank by pumping liquid from said tank to a predetermined level; and filling said tank with liquid to a predetermined level to compress the gas in said tank.

21. A method for compressing gas from an underwater well comprising:

separating gas from the effluent fluid of a gas as well;

filling a first tank with a predetermined amount of liquid;

drawing the separated gas produced by a well into said first tank by pumping liquid from said first tank to a predetermined level;

filling said first tank with liquid to a predetermined level to compress the gas in said tank;

pumping liquid from a second tank and drawing gas produced by a well into said second tank during at least a portion of the time that liquid is filling said first tank; and filling said second tank with liquid to compress gas therein during at least a portion of the time that liquid is being pumped from said first tank.

22. A submersible compressing apparatus of claim 2 further comprising:

a gas liquid separator having a gas opening, said gas opening connected to said production conduit attached to said first opening of said first compressor tank.

23. A submersible compressing apparatus of claim 4 further comprising:

a gas liquid separator having a gas opening, said gas opening connected to said production conduit attached to said first opening of said first compressor tank.

24. A submersible compressing apparatus of claim 11 further comprising:

a gas liquid separator having a gas opening, said gas opening connected to said first gas inlet conduit.

25. A submersible compressing apparatus of claim 15 further comprising:

a gas liquid separator having a gas opening, said gas opening connected to said first gas conduit means.

26. A submersible compressing apparatus of claim 18 further comprising:

a gas liquid separator having a gas opening, said gas opening connected to said gas conduit means of the first of said n compressor tanks.

27. A submersible compressing apparatus of claim 2 wherein said first and second compressor tanks are free of a device to prevent disturbance of the surface of the liquid contained in the first and second compressor tanks by the gas flowing into and out of the first and second compressor tanks.

28. A submersible compressing apparatus of claim 4 wherein said first and second compressor tanks are free of a device to prevent disturbance of the surface of the liquid contained in the first and second compressor tanks by the gas flowing into and out of the first and second compressor tanks.

29. A submersible compressing apparatus of claim 11 wherein said first and second compressor tanks are free of a device to prevent disturbance of the surface of the liquid contained in the first and second compressor tanks by the gas flowing into and out of the first and second compressor tanks.

30. A submersible compressing apparatus of claim 14 wherein said first and second compressor tanks are free of a device to prevent disturbance of the surface of the liquid contained in the first and second compressor tanks by the gas flowing into and out of the first and second compressor tanks.

31. A submersible compressing apparatus of claim 18 wherein said n compressor tanks are free of a device to prevent disturbance of the surface of the liquid contained in the n compressor tanks by the gas flowing into and out of the ii compressor tanks.

* * * * *

UNITED STATES PATENT AND TRADEMARK OFFICE

CERTIFICATE OF CORRECTION

PATENT NO. : 6,907,933 B2
DATED : June 21, 2005
INVENTOR(S) : Michael S. Choi and Donald C. Elliot It is certified that error appears in the above-identified patent and that said Letters Patent is hereby corrected as shown below:

Column 8,
Line 27, please delete "reciprosating" and insert -- reciprocating --.

Column 10,
Line 43, please delete "evacuation-conduit" and insert -- evacuation conduit --.

Signed and Sealed this

Thirtieth Day of August, 2005

JON W. DUDAS
*Director of the United States Patent and Trademark Office*